US010197327B2

(12) United States Patent
Kim

(10) Patent No.: US 10,197,327 B2
(45) Date of Patent: Feb. 5, 2019

(54) REFRIGERATOR AND BASKET ASSEMBLY THEREOF

(71) Applicant: LG ELECTRONICS INC., Seoul (KR)

(72) Inventor: Minhoon Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 15/662,542

(22) Filed: Jul. 28, 2017

(65) Prior Publication Data

US 2018/0031309 A1 Feb. 1, 2018

(30) Foreign Application Priority Data

Jul. 29, 2016 (KR) ..... 10-2016-0097229

(51) Int. Cl.

| | |
|---|---|
| ***A47B 96/04*** | (2006.01) |
| ***F25D 25/02*** | (2006.01) |
| ***F25D 23/04*** | (2006.01) |
| *F25D 25/00* | (2006.01) |
| *F25D 29/00* | (2006.01) |

(52) U.S. Cl.

CPC ..... *F25D 25/028* (2013.01); *F25D 23/04* (2013.01); *F25D 25/022* (2013.01); *F25D 25/024* (2013.01); *F25D 25/025* (2013.01); *F25D 25/00* (2013.01); *F25D 25/027* (2013.01); *F25D 29/00* (2013.01)

(58) Field of Classification Search

CPC ..... F25D 23/025; F25D 23/04; F25D 23/028; F25D 25/025; F25D 25/028; F25D 25/022; F25D 25/024; F25D 25/00; F25D 29/00; E05B 65/46; E05B 65/0014; E05B 65/0042; E05B 17/0037; E05C 3/14; E05C 19/06

USPC ..... 312/291, 292, 404, 405, 402, 405.1

See application file for complete search history.

(56) References Cited

U.S. PATENT DOCUMENTS

2013/0033163 A1* 2/2013 Kang ..... F25D 23/025 312/405.1

2013/0119846 A1* 5/2013 Seo ..... F25D 23/04 312/404

* cited by examiner

*Primary Examiner* — Daniel J Troy
*Assistant Examiner* — Timothy M Ayres
(74) *Attorney, Agent, or Firm* — Fish & Richardson P.C.

(57) ABSTRACT

A refrigerator and a basket assembly thereof are disclosed. The basket assembly includes a basket, a cover for covering the basket, a knob provided at the basket, and a protruding portion provided at the cover and fastened to the knob. The knob includes a first extension portion extending from the basket in an upwardly inclined direction to a higher position than a distal end of the protruding portion so as to support a rear surface of the protruding portion, a second extension portion extending from the first extension portion in a downwardly inclined direction, and a third extension portion extending downwards from the second extension portion. When force is applied to the third extension portion in a forward direction, the first extension portion is elastically deformed such that the distal end of the first extension portion is moved to a lower position than the distal end of the protruding portion.

20 Claims, 12 Drawing Sheets

REFRIGERATOR AND BASKET ASSEMBLY THEREOF

This application claims the benefit of Korean Patent Application No. 10-2016-0097229, filed on Jul. 29, 2016, which is hereby incorporated by reference as if fully set forth herein.

BACKGROUND OF THE INVENTION

Field of the Invention

The present invention relates to a refrigerator and a basket assembly provided in the same.

Discussion of the Related Art

A refrigerator is an apparatus for storing products, e.g. food, at a lower temperature than room temperature by supplying cool air to the same.

In general, a refrigerator generates cool air using a freezing cycle in which a refrigerant is compressed, condensed, expanded, and evaporated.

A refrigerator may include a case, in which a storage compartment is defined, a door for opening or closing the storage compartment, and a basket, which is rotatably provided at the door.

However, a conventional refrigerator has problems in that when a user opens the door, the basket is not tightly held in place but is shaken, and in that when the load applied to the basket increases, the basket is prone to be damaged due to the force of inertia.

SUMMARY OF THE INVENTION

Accordingly, the present invention is directed to a refrigerator and a basket assembly thereof that substantially obviate one or more problems due to limitations and disadvantages of the related art.

An object of the present invention is to provide a refrigerator and a basket assembly thereof, in which a rotatably connected basket is capable of being selectively moved.

Another object of the present invention is to provide a refrigerator and a basket assembly thereof, in which a fastening unit for holding a basket in place has a simple structure, thereby facilitating formation or assembly thereof and reducing manufacturing costs.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve the object and other advantages and in accordance with the purpose of the invention, as embodied and broadly described herein, a refrigerator includes a basket assembly disposed in a storage compartment or a door to store products therein, the basket assembly including a basket having an open top portion and a storage space formed therein to store products therein, a cover for covering the top portion of the basket, a knob provided at the basket and configured to be elastically deformable, and a protruding portion provided at the cover and fastened to the knob, wherein the knob includes a first extension portion extending from a front panel of the basket in an upwardly inclined direction to a higher position than a distal end of the protruding portion so as to support a rear surface of the protruding portion, a second extension portion extending from a distal end of the first extension portion in a downwardly inclined direction, and a third extension portion extending from the second extension portion in a downward direction, and wherein when a user applies force to the third extension portion in a forward direction, the first extension portion is elastically deformed such that the distal end of the first extension portion is moved to a lower position than the distal end of the protruding portion.

The knob may further include a fourth extension portion, extending from the second extension portion to a higher position than the distal end of the protruding portion, and a fastening groove, formed between the second extension portion and the fourth extension portion to allow the distal end of the protruding portion to be inserted thereinto.

The second extension portion may be formed to be shorter than the first extension portion.

The third extension portion may be formed to be longer than the second extension portion.

The distal end of the first extension portion may be located at a higher position than a distal end of the fourth extension portion.

The knob may have left and right ends configured as free ends.

The basket may be rotatably or slidably provided.

In another aspect of the present invention, a basket assembly disposed in a storage compartment or a door to store products therein includes a basket having an open top portion and a storage space formed therein to store products therein, a cover for covering the top portion of the basket, a knob provided at the basket and configured to be elastically deformable, and a protruding portion provided at the cover and fastened to the knob, wherein the knob includes a first extension portion extending from a front panel of the basket in an upwardly inclined direction to a higher position than a distal end of the protruding portion so as to support a rear surface of the protruding portion, a second extension portion extending from a distal end of the first extension portion in a downwardly inclined direction, and a third extension portion extending from the second extension portion in a downward direction, and wherein when a user applies force to the third extension portion in a forward direction, the first extension portion is elastically deformed such that the distal end of the first extension portion is moved to a lower position than the distal end of the protruding portion.

The knob may further include a fourth extension portion, extending from the second extension portion to a higher position than the distal end of the protruding portion, and a fastening groove, formed between the second extension portion and the fourth extension portion to allow the distal end of the protruding portion to be inserted thereinto.

The second extension portion may be formed to be shorter than the first extension portion.

The distal end of the first extension portion may be located at a higher position than a distal end of the fourth extension portion.

The knob may have left and right ends configured as free ends.

The basket may be rotatably or slidably provided.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. A configuration or a control method of an apparatus described below is provided for explanation of the embodiments of the present invention and is not intended to limit the technical scope of the present invention. Wherever possible, the same reference numbers will be used throughout the drawings to refer to the same or like parts.

Unless otherwise defined, all terms used herein have the same meaning as commonly understood by those skilled in the art to which this invention pertains. It will be further understood that terms, such as those defined in commonly used dictionaries, should be interpreted as having a meaning that is consistent with their meaning in the context of the relevant art and are not to be interpreted in an ideal or excessively formal sense unless clearly defined in the present specification.

Figure 1:
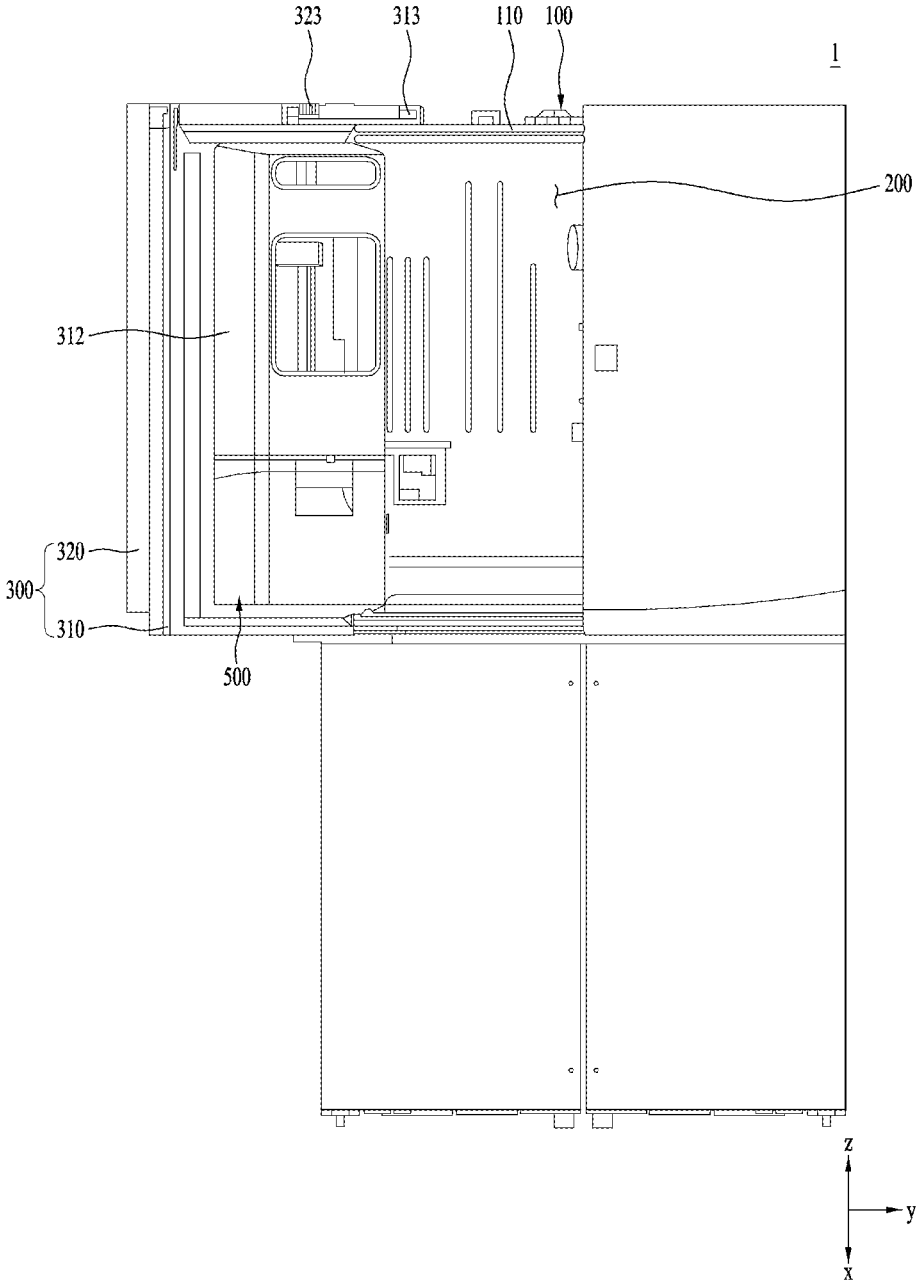
FIG. 1 is a view illustrating a refrigerator with a main door opened according to an embodiment of the present invention.

An orthogonal coordinate system is used in FIG. 1, in which the X-axis direction refers to the forward direction, the Z-axis direction refers to the upward direction, and the Y-axis direction refers to the rightward direction.

Figure 2:
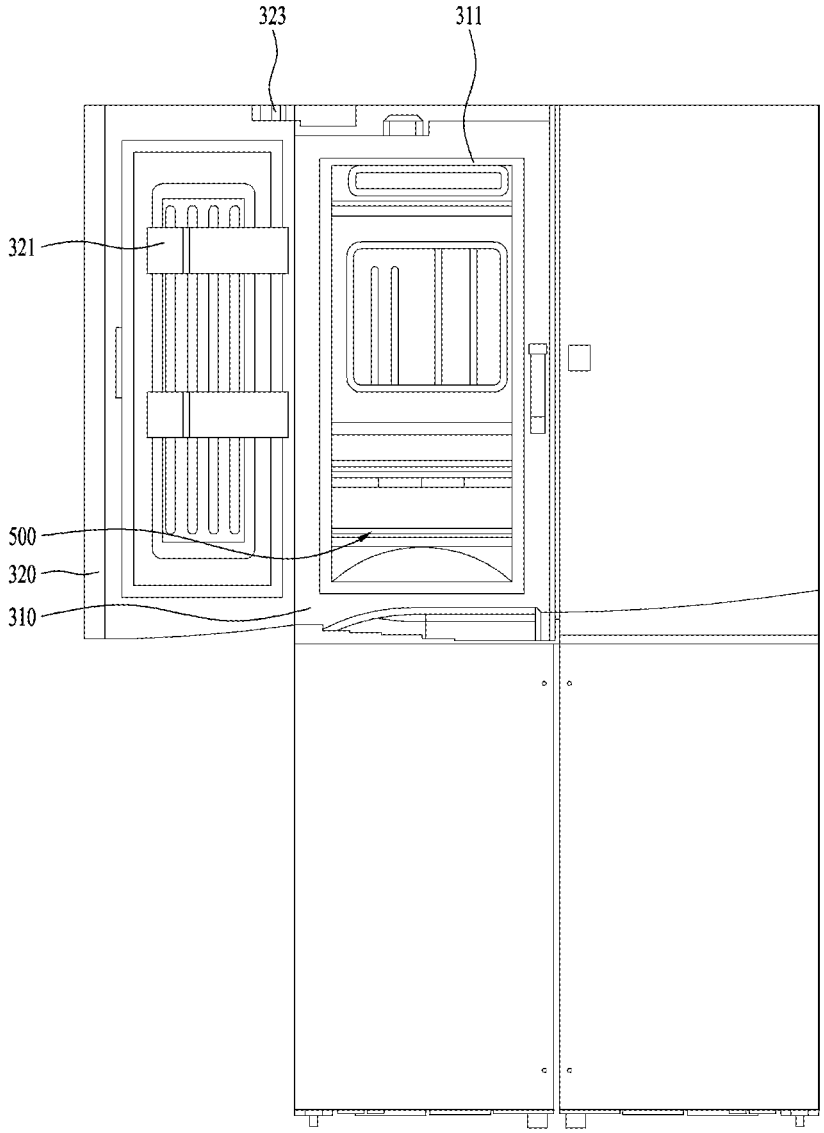
FIG. 2 is a view illustrating the refrigerator with a sub-door opened according to the embodiment of the present invention.
Figure 3:
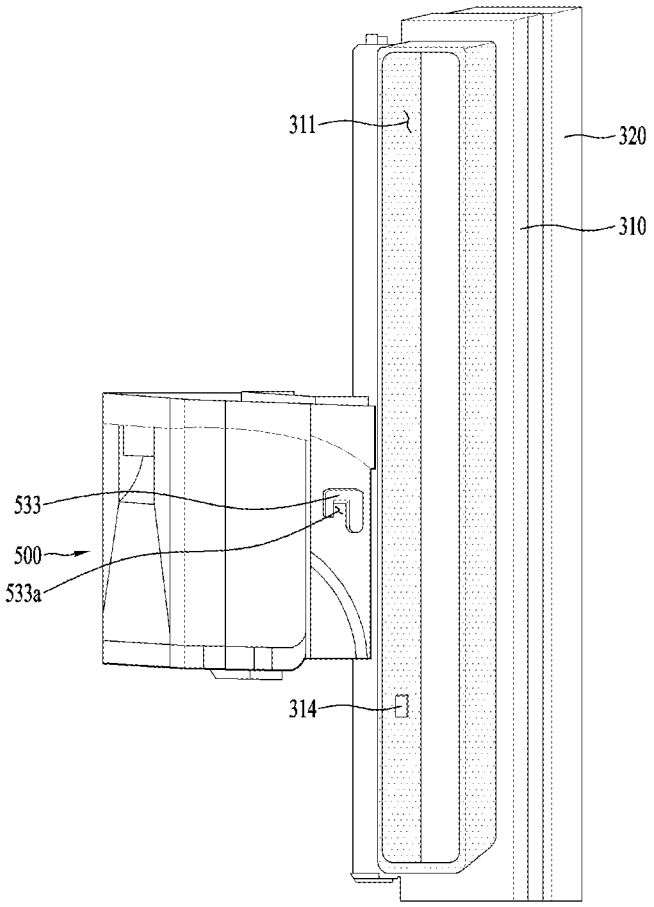
FIG. 3 is an exploded perspective view of a basket assembly and a door according to the embodiment of the present invention.

FIG. 1 is a view illustrating a refrigerator with a main door opened according to an embodiment of the present invention. FIG. 2 is a view illustrating the refrigerator with a sub-door opened according to the embodiment of the present invention. FIG. 3 is an exploded perspective view of a basket assembly and a door according to the embodiment of the present invention.

Hereinafter, the refrigerator according to the embodiment of the present invention will be described with reference to FIGS. 1 to 3.

Referring to FIGS. 1 and 2, the refrigerator according to the embodiment of the present invention may include a case 100, a storage compartment 200 defined in the case 100, a door 300 for opening or closing the storage compartment 200, and a basket assembly 500, which is provided in the door 300 or the storage compartment to store products therein.

The case 100 defines the external appearance of the refrigerator. The case 100 includes an insulation material for insulating the interior of the storage compartment 200 from the surrounding atmosphere.

The storage compartment 200 may include a freezing compartment for storing products in a frozen state by cooling the same at a temperature below zero and a refrigerating compartment for storing products in a refrigerated state by cooling the same at a temperature above zero but lower than room temperature.

The refrigerator may generate cool air using a freezing cycle. The freezing cycle operates such that refrigerant is repeatedly compressed, condensed, expanded, and evaporated. The freezing cycle may include a compressor for compressing the refrigerant, a condenser for condensing the refrigerant, an expansion device for expanding the refrigerant, and an evaporator for evaporating the refrigerant. The compressor, the condenser, the expansion device, and the evaporator are connected to one another via refrigerant pipes. The condenser is connected to the outlet of the compressor. The expansion device is connected to the outlet of the condenser. The evaporator is connected to the outlet of the expansion device. The compressor is connected to the outlet of the evaporator. In this way, the compressor, the condenser, the expansion device, and the evaporator are connected in a circulation structure.

The storage compartment 200 may communicate with the outside through an entrance 110 formed in the front surface of the case 100. Products may be put into or taken out of the storage compartment 200 through the entrance 110 in the case 100.

The door 300 serves to open or close the entrance 110 in the case 100 in order to selectively seal the storage compartment 200.

The door 300 may include a main door 310, which is rotatably connected to the case 100 using a main door hinge 313, and a sub-door 320, which is rotatably connected to the main door 310 or the case 100 using a sub-door hinge 323.

The main door 310 may have an opening 311 formed therein so as to communicate with the entrance 110 in the case 100. The opening 311 may be opened or closed by the sub-door 320.

The main door 310 may include a door storage chamber 312 and a basket assembly 500.

The door storage chamber 312 may be provided in the opening 311 such that when the sub-door 320 is opened, the front of the door storage chamber 312 is visible, and such that when the main door 310 is opened, the back of the door storage chamber 312 is visible.

The door storage chamber 312 may be used to store products that are frequently used, e.g. drinking water. The door storage chamber 312 may have entrances (not shown) formed in the front and back thereof, through which the user puts or takes products into or out of the door storage chamber 312 in the open state of the sub-door 320 or the main door 310.

The basket assembly 500 may be provided in the opening 311 such that when the sub-door 320 is opened, the front of the basket assembly 500 is visible, and such that when the main door 310 is opened, the back of the basket assembly 500 is visible.

Referring to FIG. 3, in order to secure the basket assembly 500 to the door, the basket assembly 500 may have fixing portions 533 provided on left and right sides thereof. The fixing portions 533 may protrude from the left and right sides of the basket assembly 500. Each of the fixing portions 533 may have a fixing recess 533*a* that is open in the downward direction.

Fixing projections 314, which are provided in the inner peripheral surface of the opening 311 of the door, are inserted into the fixing recesses 533*a* in the fixing portions 533, thereby securing the basket assembly 500 to the opening 311 of the door.

The basket assembly 500 may be disposed in the lower portion of the door storage chamber 312. The basket assembly 500 includes a basket 510 for storing products therein.

Figure 4:
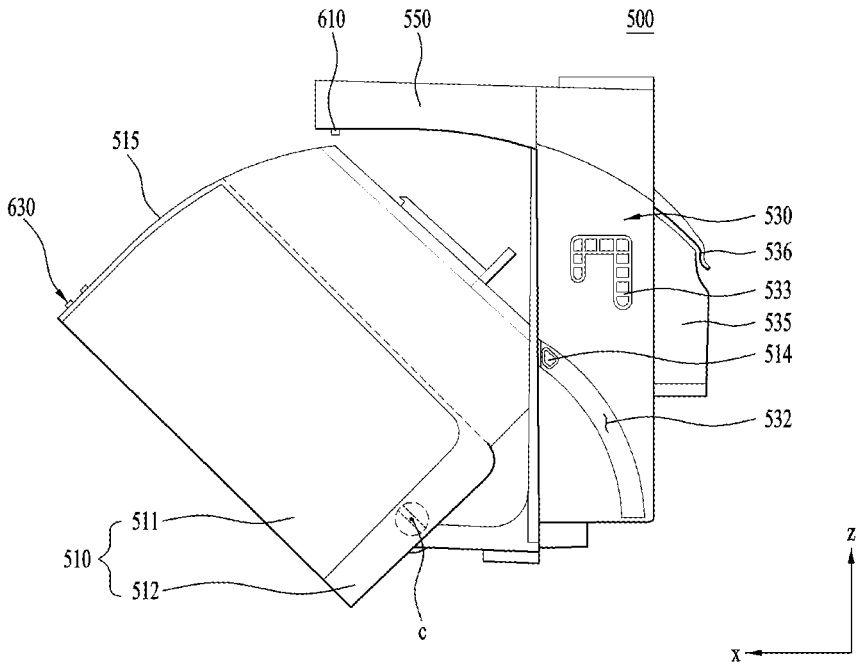
FIG. 4 is a view illustrating the basket assembly with a basket opened according to the embodiment of the present invention.
Figure 5:
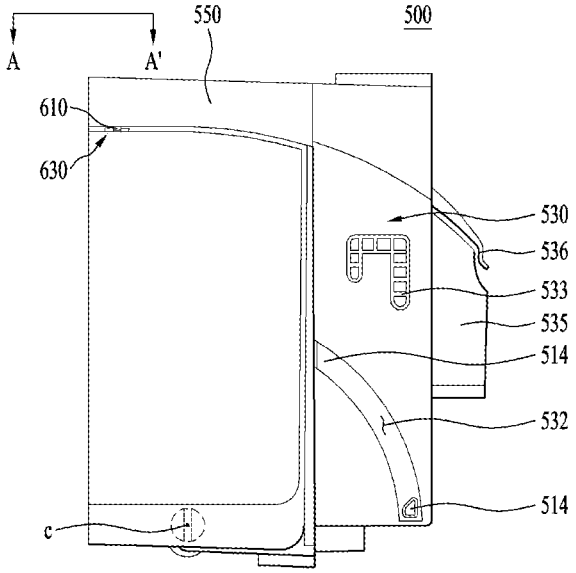
FIG. 5 is a view illustrating the basket assembly with the basket closed according to the embodiment of the present invention.
Figure 6:
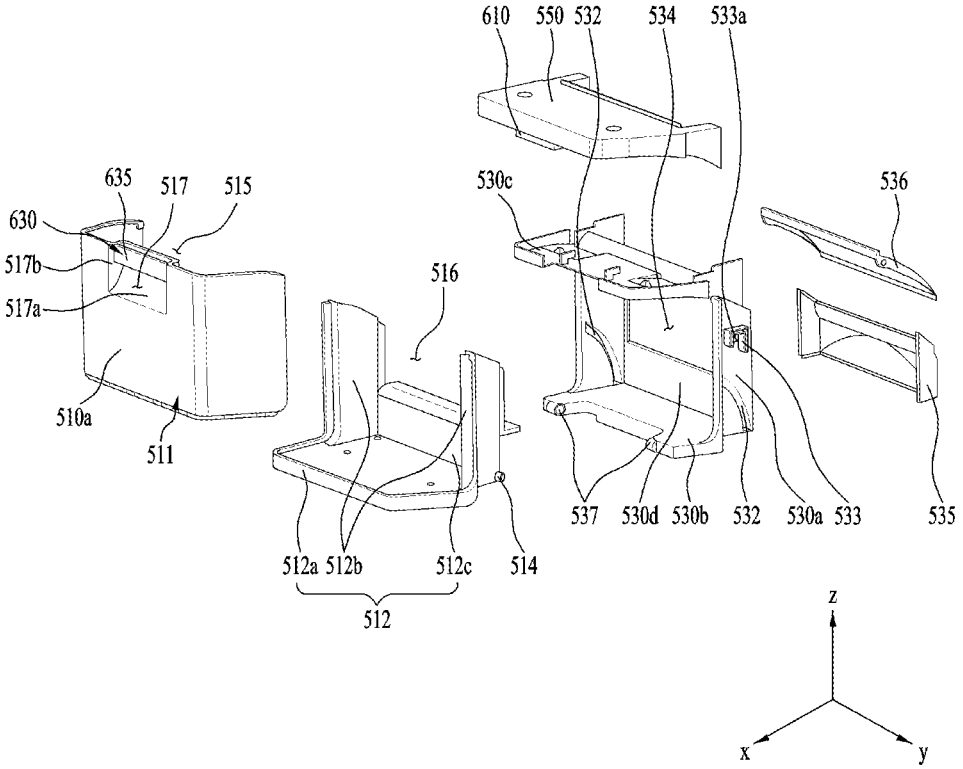
FIGS. 6 and 7 are exploded perspective views of the basket assembly according to the embodiment of the present invention.
Figure 7:
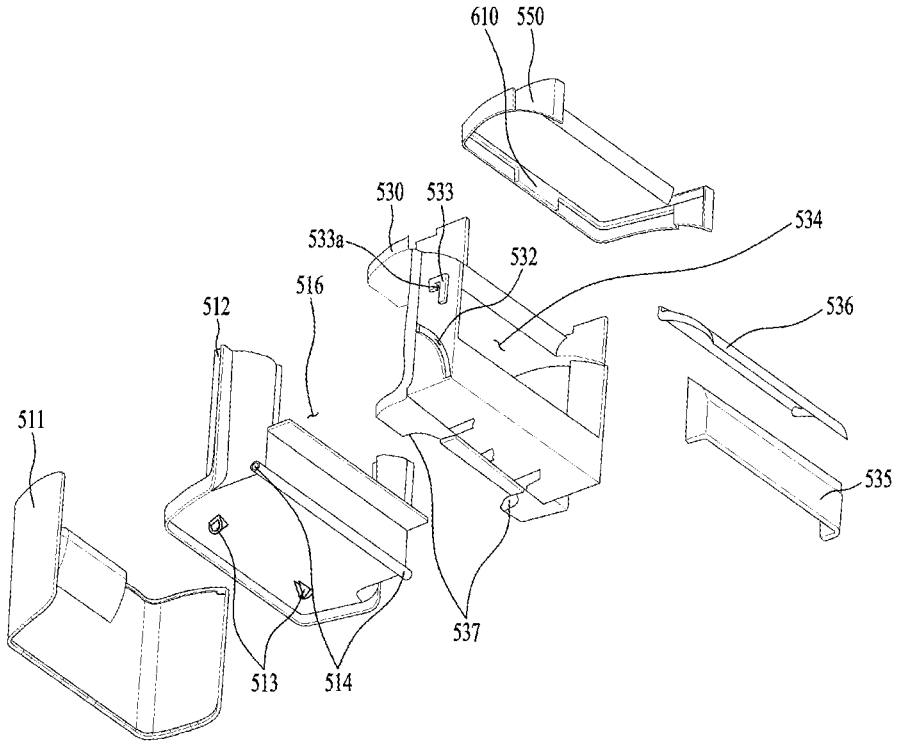

FIG. 4 is a view illustrating the basket assembly with the basket opened according to the embodiment of the present invention. FIG. 5 is a view illustrating the basket assembly with the basket closed according to the embodiment of the present invention. FIGS. 6 and 7 are exploded perspective views of the basket assembly according to the embodiment of the present invention.

An orthogonal coordinate system shown in FIGS. 4 and 6, which illustrate the basket assembly, is defined such that the X-axis direction refers to the forward direction, the Y-axis direction refers to the rightward direction, and the Z-axis direction refers to the upward direction, on the basis of which the basket assembly will now be described.

Referring to FIGS. 4 and 5, the basket assembly 500 may include a basket 510, which has an open top portion and a storage space formed therein to store products therein, a cover 550 for covering the top portion of the basket 510, a knob 630, which is provided at the basket 510 and is elastically deformable, and a protruding portion 610, which is provided at the cover 550 and is fastened to the knob 630.

The basket 510 may have a storage space formed therein to store products therein, and an entrance 515 formed in the top portion thereof.

The user may put or take products into or out of the storage space through the entrance 515 in the basket 510. The entrance 515 in the basket 510 may be opened or closed by the cover 550 in accordance with the rotation of the basket 510.

The cover 550 may be fixed in place so as not to be moved, and therefore the entrance 515 in the basket 510 may be opened or closed by the cover 550 in accordance with the rotation of the basket 510.

For example, when the basket 510 is rotated in the forward direction, the entrance 515 is opened, and when the basket 510 is rotated in the backward direction, the entrance 515 is closed.

The basket assembly 500 may further include a support unit 530, to which the basket 510 is rotatably connected.

The cover 550 may be securely connected to the top of the support unit 530.

The reference character C denotes a rotation axis, about which the basket 510 is rotated.

Referring to FIGS. 6 and 7, in order to realize the rotation of the basket 510, the basket assembly 500 may include rotation protrusions 513, which are provided at the bottom of the basket 510, and protrusion-insertion holes 537, which are formed in the support unit 530 and into which the rotation protrusions 513 are rotatably inserted.

The protrusion-insertion holes 537 may be formed in one end of a lower panel 530*b* of the support unit 530. Therefore, the rotation protrusions 513 form the rotation axis C, and the basket 510 is connected to the support unit 530 so as to be rotated about the rotation axis C.

In order to prevent the basket 510 from being rotated beyond a predetermined angle, the basket 510 may include stoppers 514.

The stoppers 514 may be configured as protrusions that extend outward from left and right panels of the basket 510, and may be guided by guide slots 532 formed in the support unit 530.

The stoppers 514 are spaced apart from the rotation protrusions 513. Therefore, when the basket 510 is rotated about the rotation axis C, i.e. about the rotation protrusions 513, the stoppers 514 are moved in a circumferential direction along a predetermined arc path, which is defined by the guide slots 532. At this time, the moving distance in the circumferential direction of the stoppers 514 is restricted by the length of the guide slots 532.

The guide slots 532 may be formed in left and right panels 530*a* of the support unit 530.

The basket 510 may include a window 511, which is formed of a transparent material so that the storage space is visible from the outside, and a main body 512, to which the window 511 is coupled so as to form the storage space.

The main body 512 may include a bottom panel 512*a*, left and right panels 512*b*, which extend upwards from the left and right ends of the bottom panel 512*a*, and a rear panel 512*c*, which extends upwards from the rear end of the bottom panel 512*a*. The bottom panel 512*a* may be expanded forward further than the left and right panels 512*b*.

The window 511 may define a front portion of the basket 510. The window 511 may be fixedly coupled to the periphery of the bottom panel 512*a*. Therefore, as a result of the window 511 and the main body 512 being coupled to each other, the storage space is defined.

The basket 510 may include an opening 516, which is open in the backward direction. The opening 516 may be formed in the rear panel 512*c* of the main body 512.

The support unit 530, to which the basket 510 is rotatably connected, is secured to the main door 310 or the storage compartment 200.

The support unit 530 may include left and right panels 530*a*, a bottom panel 530*b*, a top panel 530*c*, and a rear panel 530*d*. The left and right panels 530*a* may be formed in a manner of extending upwards from the left and right ends of the bottom panel 530*b*. The rear panel 530*d* may be formed in a manner of extending upwards from the rear end of the bottom panel 530*b*. The top panel 530*c* may be formed in a manner of being connected to the upper ends of the left and right panels 530*a*.

The support unit 530 may have therein a rear entrance 534, which is open in the backward direction. The rear entrance 534 may communicate with the opening 516 formed in the basket 510. When the basket 510 is not in a rotated state in the forward direction, the opening 516 in the basket 510 and the rear entrance 534 in the support unit 530 communicate with each other.

In the case in which the support unit 530 is secured to the opening 311 in the door, when the main door 310 is closed and the sub-door 320 is open, the rear entrance 534 in the support unit 530 is exposed toward the region ahead of the refrigerator 1, and the user is capable of putting or taking products into or out of the storage space in the basket 510 through the rear entrance 534 and the opening 516.

The present invention may include a rear window 535, which is mounted to the rear entrance 534 so that the interior of the basket 510 is visible from the outside. The rear window 535 may be provided so as to cover a portion of the rear entrance 534.

In addition, in order to prevent cool air from leaking through the rear entrance 534, the present invention may include a rotating cover 536 for opening or closing the rear entrance 534. The rotating cover 536 may be rotatably connected to the support unit 530.

The cover 550 may be coupled to the top panel 530*c* of the support unit 530. As such, the cover 550, which is coupled to the top panel 530*c* of the support unit 530, serves to open or close the entrance 515 in the basket 510.

Although not illustrated in the drawings, another embodiment of the present invention may be constructed such that the basket assembly is not formed by the basket and the cover. For example, the basket may be rotatably connected to the door or the storage compartment, and the cover may be fixedly provided at the door or the storage compartment.

Figure 8:
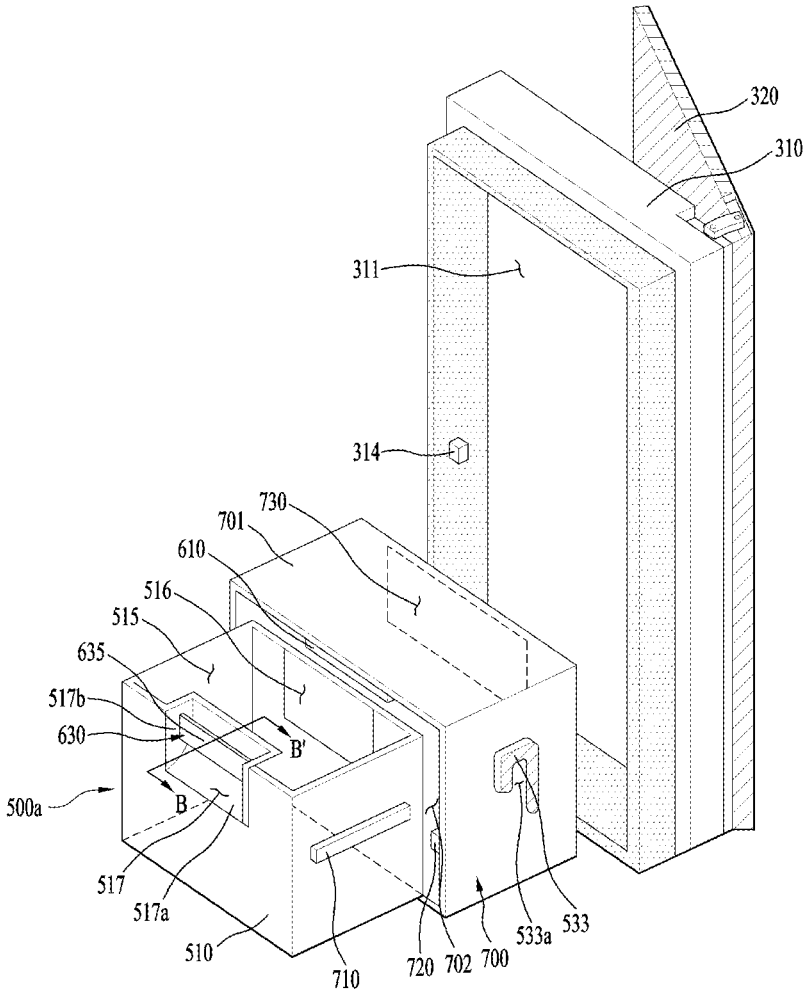
FIG. 8 is an exploded perspective view of a basket assembly and a door according to a further embodiment of the present invention.

FIG. 8 is an exploded perspective view of a basket assembly and a door according to a further embodiment of the present invention.

The construction of the basket assembly 500 according to the above-described previous embodiment may be identically applied to a basket assembly 500*a* according to this embodiment, as long as it does not conflict with the rectilinear movement of a basket.

Hereinafter, the difference from the previous embodiment will be described with reference to FIG. 8.

The basket assembly 500*a* according to this embodiment may include a housing 700, which has an entrance 702 formed in a portion thereof, and a basket 510, which is inserted into or drawn out of the housing 700 through the entrance 702.

The basket 510 may move rectilinearly in the housing 700. To achieve this, the present invention may include rails 710, which are provided at left and right panels of the basket 510, and rail guides 720, which are provided at the inner surfaces of left and right panels of the housing 700 so as to support or cooperate with the rails 710.

The basket 510 may have an entrance 515 formed in the top portion thereof. The top panel of the housing 700 may serve as a cover 701 for opening or closing the entrance 515 in accordance with the movement of the basket 510.

The housing 700 may have an opening 730, which is formed in the rear panel thereof so as to communicate with an opening 516 in the basket. When the sub-door 320 is in the open state, the user is capable of putting or taking products into or out of the basket through the opening 730 in the housing 700 and the opening 516 in the basket. In addition, although not illustrated in the drawings, in order to prevent cool air from leaking from the interior of the basket, the opening 730 in the housing 700 may be opened or closed by a cover (not shown), which is rotatably connected to the housing 700.

Figure 9:
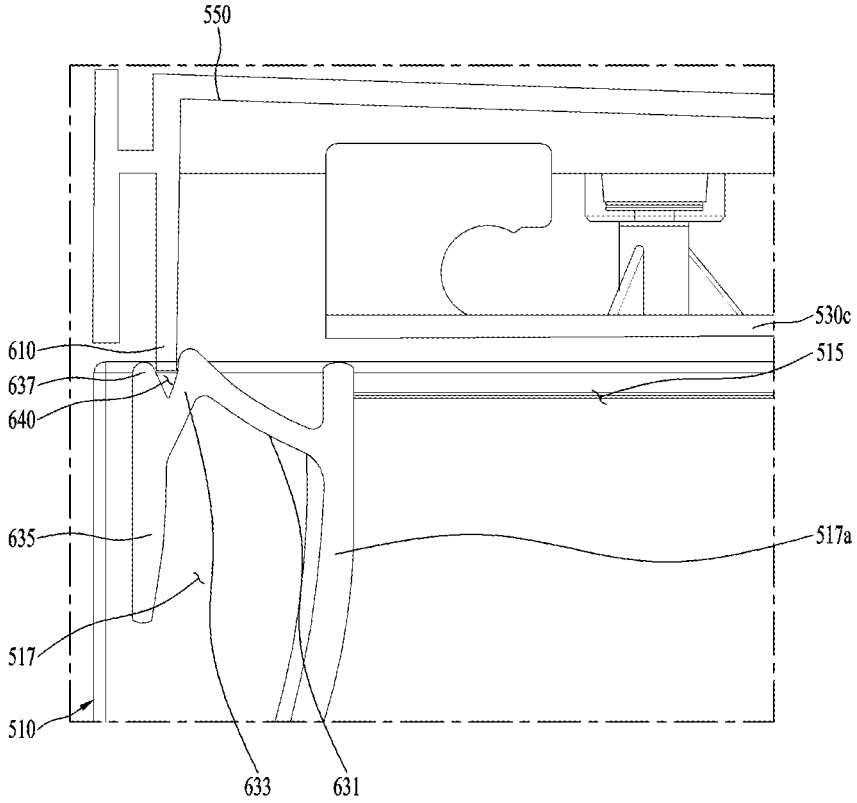
FIG. 9 is an enlarged sectional view taken along line A-A' in FIG. 5 or taken along line B-B' in the state in which a basket is received in a housing in FIG. 8.
Figure 10:
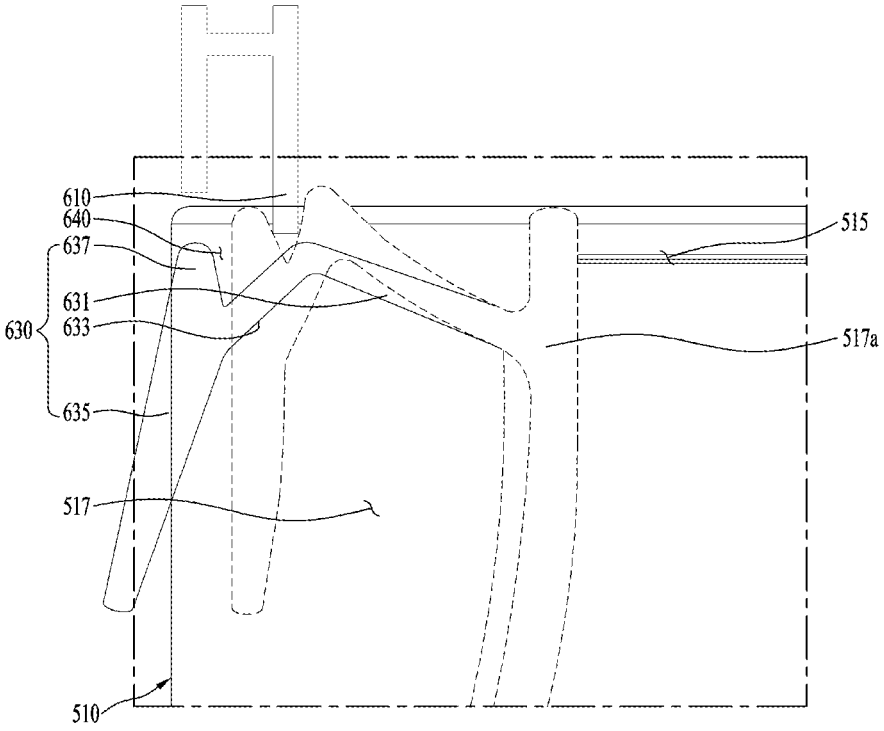
FIG. 10 is a view illustrating deformation of a fastening unit of the basket when force is applied to a knob shown in FIG. 9 in the forward direction.
Figure 11:
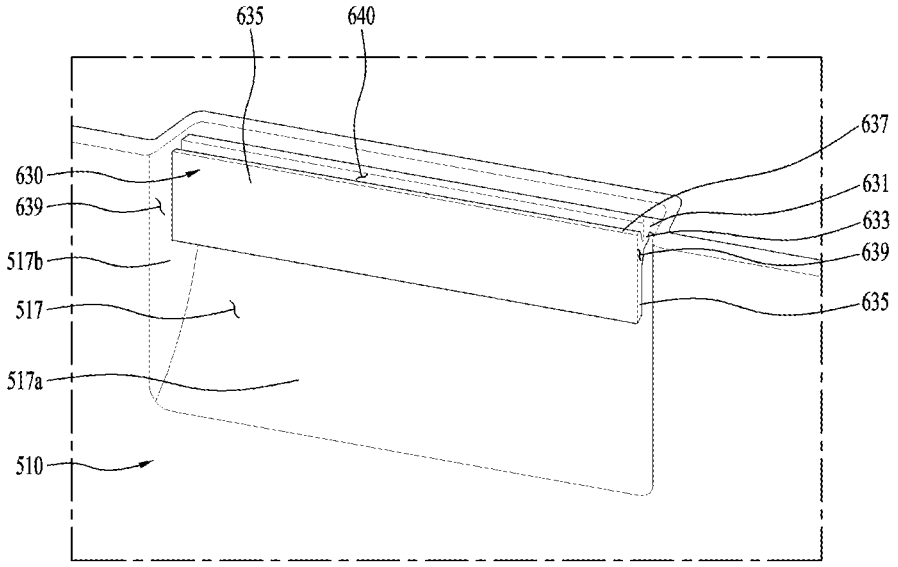
FIG. 11 is an enlarged view of the front portion of the basket.

FIG. 9 is an enlarged sectional view taken along line A-A' in FIG. 5 or taken along line B-B' in the state in which the basket is received in the housing in FIG. 8. FIG. 10 is a view illustrating the deformation of a fastening unit of the basket when force is applied to a knob shown in FIG. 9 in the forward direction. FIG. 11 is an enlarged view of the front portion of the basket.

Hereinafter, a fastening unit for holding the basket in place will be described with reference to FIGS. 9 to 11.

As described above, the basket 510 may be rotatably connected to the support unit 530. Alternatively, the basket 510 may be provided so as to move rectilinearly relative to the housing 700 in the manner of a drawer.

In either case, when the main door 310 is rotated, the force of inertia may act on the basket 510, causing the basket 510 to be moved and opened.

The present invention may include a fastening unit for preventing the basket 510 from being opened due to the opening of the main door 310.

The fastening unit may include a knob 630, which is provided at the basket 510 and is elastically deformable, and a protruding portion 610, which is provided at the cover 550 and is fastened to the knob 630. The protruding portion 610 may extend downwards from the cover 550, and the knob 630 is detachably fastened to the protruding portion 610 via elastic deformation thereof, thereby selectively holding the basket 510 in place.

The protruding portion 610 extends from the front end of the cover 550. The protruding portion 610 is formed such that the distal end thereof does not interfere with the rotating route of the upper end of the window 511 of the basket and such that when the basket 510 is rotated, the front surface of the basket 510 is prevented from being caught by the protruding portion 610.

The protruding portion 610 may be formed to be smaller than the length in the lateral direction (i.e. the width) of the cover 550. The protruding portion 610 may be formed to be smaller than the length in the lateral direction (i.e. the width) of the basket 510.

As shown in FIG. 9, the knob 630 may include a first extension portion 631, which extends from a front panel 510*a* of the basket in the forward-upwardly inclined direction so as to support the rear surface of the protruding portion 610, a second extension portion 633, which extends from the distal end of the first extension portion 631 in the forward-downwardly inclined direction, and a third extension portion 635, which extends from the second extension portion 633 in the downward direction.

The distal end of the first extension portion 631 may be located at a higher position than the distal end of the protruding portion 610. The first extension portion 631 supports the rear surface of the protruding portion 610. Therefore, the basket 510 is prevented from being rotated in the forward direction and is maintained in a state of being secured to the support unit 530.

The first extension portion 631 may be formed of an elastic material so that the shape thereof is changed when external force is applied thereto. Specifically, when external force is applied to the first extension portion 631, the portion of the first extension portion 631 that is connected to the front panel of the basket is elastically deformed, making it possible for the basket 510 to be rotated.

The third extension portion 635 may be formed to extend from the distal end of the second extension portion 633 in the downward direction.

The first extension portion 631 and the second extension portion 633 may be formed of an elastically deformable material. Further, the third extension portion 635 may also be formed of an elastically deformable material.

The third extension portion may be formed of a material that has lower elastic deformability characteristics than the first extension portion or the second extension portion. Alternatively, the third extension portion may be formed to have a thickness greater than the first extension portion or the second extension portion so that the third extension portion is elastically deformed relatively slightly.

When the user applies force to the third extension portion 635 in the forward direction, the first extension portion 631 and the second extension portion 633 may be elastically deformed such that the distal end of the first extension portion 631 is moved to a lower position than the distal end of the protruding portion 610.

Specifically, when the user applies force to the third extension portion 635 in the forward direction, in other words, when the user pulls the third extension portion 635 in the forward direction, the first extension portion 631 may be rotated in the downward direction, with the result that the distal end of the first extension portion 631 is moved to a lower position than the distal end of the protruding portion 610.

The second extension portion 633 may be formed to be shorter than the first extension portion 631. Therefore, when the pulling force is applied to the third extension portion 635 in the forward direction, the force is transferred with little loss to the distal end of the second extension portion 633, which is connected to the third extension portion 635, and is converted into the force that rotates the first extension portion 631, which is longer than the second extension portion 633. Accordingly, it is possible to move the distal end of the first extension portion 631 to a lower position than the distal end of the protruding portion 610 with relatively small force.

Meanwhile, the knob 630 may include a fourth extension portion 637, which extends from the second extension portion 633 to a higher position than the distal end of the protruding portion 610.

The fourth extension portion 637 may extend from the connection portion between the second extension portion 633 and the third extension portion 635. The fourth extension portion 637 may extend in the upward direction. The fourth extension portion 637 may selectively contact the front end of the protruding portion 610.

A fastening groove 640 may be formed between the fourth extension portion 637 and the second extension portion 633, into which the distal end of the protruding portion 610 is inserted.

The fastening groove 640 may be formed to have a V-shaped cross-section. The distal end of the protruding portion 610 may be inserted into the fastening groove 640 and may be maintained in contact with the inner surface of the fastening groove 640.

When the basket 510 is secured to the support unit 530 and the distal end of the protruding portion 610 is received in the fastening groove 640, the rear surface of the protruding portion 610 may be supported by the first extension portion 631, and the front surface of the protruding portion 610 may be supported by the fourth extension portion 637.

The third extension portion 635 may be formed to be longer than the second extension portion 633. Further, the third extension portion 635 may be formed to be longer than the fourth extension portion 637.

When the user applies force to the distal end of the third extension portion 635, the fourth extension portion 637 is brought into contact with the front surface of the protruding portion 610 and applies force to the same utilizing the connection portion between the second extension portion 633 and the third extension portion 635 as a fulcrum point, according to the principle of a lever.

Even when the user applies relatively small force to the third extension portion 635, a relatively large force is applied to the distal end of the fourth extension portion 637, with the result that the second extension portion 633 is easily deformed.

The distal end of the first extension portion 631 may be located at a higher position than the distal end of the fourth extension portion 637. Therefore, except for the case in which the basket 510 is rotated in the forward direction according to the user's intention, the basket 510 is prevented from being separated from the support unit 530 due to the opening force of the door.

Meanwhile, the left and right ends of the knob 630 may be configured as free ends.

The left and right ends of each of the first to third extension portions 631, 633 and 635 may be configured as free ends. Further, the left and right ends of the fourth extension portion 637 may also be configured as free ends. Therefore, the deformation of the first to third extension portions 631, 633 and 635 may be facilitated.

Meanwhile, the basket 510 may have a holding space 517, which is backwardly recessed from the front panel 510*a* of the basket 510.

The holding space 517 may be formed in the upper end portion of the front panel 510*a* of the basket 510.

The holding space 517 may be defined by a front panel 517*a*, which can been seen by the user, and left and right panels 517*b*, which extend from the left and right ends of the front panel 517*a* and are connected to the front panel 510*a* of the basket 510.

The knob 630 may be provided in the holding space 517. Specifically, the first extension portion 631 may extend from the front panel 517*a* of the holding space 517. In addition, gaps 639 may be formed between the left and right panels 517*b* of the holding space 517 and the left and right ends of each of the first to fourth extension portions 631, 633, 635 and 637 so that the left and right ends of each of the first to fourth extension portions 631, 633, 635 and 637 are configured as free ends.

Figure 12:
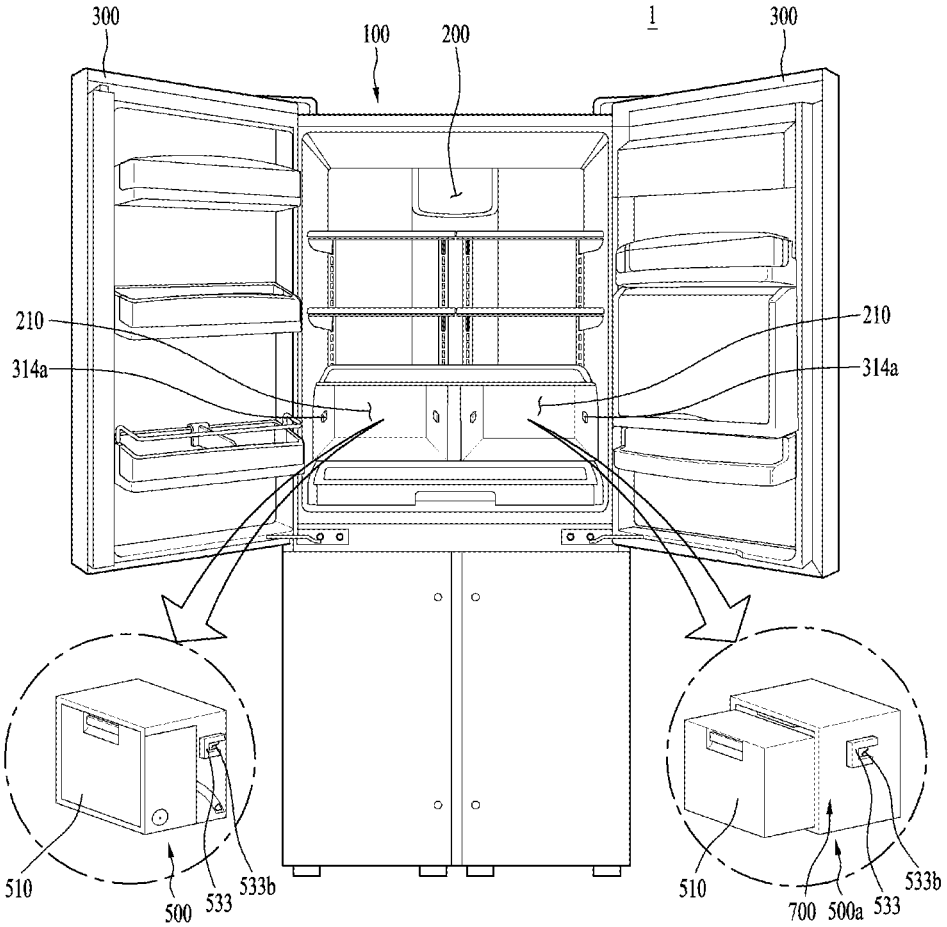
FIG. 12 is a view illustrating a refrigerator in which the basket assembly is provided in a storage compartment.

FIG. 12 is a view illustrating a refrigerator in which the basket assembly is provided in the storage compartment.

The construction in which the basket assembly is mounted to the door has been described above. Hereinafter, the refrigerator in which the basket assemblies according to the above-described embodiments are provided in the storage compartment will be described with reference to FIG. 12.

As shown in FIG. 12, the basket assemblies 500 and 500*a* may be provided in the storage compartment 200. The storage compartment 200 may have receiving spaces 210 formed therein to receive the basket assemblies therein.

Fixing portions 533 may be provided at the left and right panels of each of the basket assemblies, and each of the fixing portions 533 may have a fixing recess 533*b* formed to be open in the backward direction. When each of the basket assemblies is inserted into a corresponding one of the receiving spaces, fixing projections 314*a*, which are provided at the inner surface of each of the receiving spaces, may be fitted into the corresponding fixing recesses 533*b*, with the result that the basket assemblies are securely received in the receiving spaces.

As is apparent from the above description, in a refrigerator and a basket assembly thereof according to an embodiment of the present invention, a rotatably connected basket is capable of being selectively moved.

In addition, the basket may be configured to slide in a rectilinear reciprocating movement manner.

In addition, a fastening unit for holding the basket in place has a simple structure, thereby facilitating formation or assembly thereof and reducing manufacturing costs.

In addition, it is possible to rotate the basket with relatively small force.

In addition, the basket assembly according to the embodiment of the present invention is also capable of being mounted to a storage compartment, without being restricted to a door.

It will be apparent to those skilled in the art that various modifications and variations can be made in the present invention without departing from the spirit or scope of the invention. Thus, it is intended that the present invention covers the modifications and variations of this invention provided they come within the scope of the appended claims and their equivalents.

What is claimed is:

1. A refrigerator comprising:

a case that defines a storage compartment;

a door connected to the case and configured to open and close the storage compartment;

a basket located in the storage compartment and configured to store a product, the basket defining an open top portion; and a cover disposed vertically above the basket and configured to cover the open top portion of the basket;

wherein the basket includes:

a main body comprising a front panel, a rear panel, and side panels that connect the front panel and the rear panel;

a first extension portion that extends in a first direction from a front panel of the basket, a second extension portion that extends in a second direction from a distal end of the first extension portion and that defines an angle with respect to the first extension portion, and a locking portion located between the first extension portion and the second extension portion and configured to contact a portion of the cover, the locking portion being configured to restrict movement of the basket relative to the cover based on contacting the portion of the cover, wherein the locking portion is further configured to, based on the second extension portion being pulled forward to increase the angle of the second extension portion with respect to the first extension portion, be spaced apart from the portion of the cover, and wherein the basket is configured to withdraw forward relative to the cover based on the locking portion being spaced apart from the portion of the cover.

2. The refrigerator according to claim 1, wherein the door is further configured to open and close an entrance of the case and to selectively provide a seal to the storage compartment, wherein the door includes:

a main door rotatably connected to the case by a main door hinge, and a sub-door rotatably connected to the main door or the case by a sub-door hinge, wherein the basket is provided in the sub-door, and wherein the basket is configured to move in a direction different from a direction of rotation of the sub-door.

3. The refrigerator according to claim 2, wherein the sub-door hinge includes a rotating shaft that extends in a first direction, and wherein the basket further includes rotation protrusions that is located at the basket and that extends in a second direction perpendicular to the first direction, the basket being configured to rotate about the rotation protrusions.

4. The refrigerator according to claim 2, wherein the sub-door hinge includes a rotating shaft that extends in a first direction, and wherein the basket further includes rails that is located at the basket, that extends in a third direction perpendicular to the first direction, and that are configured to guide movement of the basket.

5. The refrigerator according to claim 1, wherein the storage compartment includes a receiving space configured to receive the basket.

6. The refrigerator according to claim 1, wherein the basket is disposed in the door.

7. The refrigerator according to claim 1, wherein the refrigerator further comprises a protruding portion that protrudes downward from the cover, wherein the first extension portion extends upward from the front panel of the basket to a first position higher than an end of the protruding portion in an inclined direction with respect to the front panel, the first extension portion being configured to support a rear surface of the protruding portion, wherein the second extension portion extends downward from the distal end of the first extension portion, and wherein the basket further includes a third extension portion that extends downward from the second extension portion.

8. The refrigerator according to claim 7, wherein the basket further includes:

a fourth extension portion that extends upward from the second extension portion to a third position higher than the end of the protruding portion; and a fastening groove defined between the second extension portion and the fourth extension portion and configured to receive the end of the protruding portion.

9. The refrigerator according to claim 7, wherein a length of the second extension portion is shorter than a length of the first extension portion.

10. The refrigerator according to claim 7, wherein a length of the third extension portion is longer than a length of the second extension portion.

11. The refrigerator according to claim 8, wherein the distal end of the first extension portion is located at a position higher than a distal end of the fourth extension portion.

12. The refrigerator according to claim 7, wherein the basket includes a first end and a second end opposite the first end that are spaced apart from the basket to form free ends.

13. The refrigerator according to claim 7, wherein the basket is rotatably or slidably provided in the storage compartment.

14. A basket assembly disposed in a storage compartment or a door to store products therein, the basket assembly comprising:

a basket defining an open top portion and a storage space configured to store the products;

a cover disposed vertically above the basket and configured to cover the open top portion of the basket;

a knob provided at the basket and configured to elastically deform; and a protruding portion protruding downward from the cover and configured to be caught by to the knob, wherein the knob includes:

a first extension portion that extends from a front panel of the basket, and a second extension portion that extends from the first extension portion in an inclined direction to thereby define an angle with respect to the first extension portion, and wherein the basket is configured to withdraw based on a change of the angle of the second extension portion with respect to the first extension portion.

15. The basket assembly according to claim 14, wherein the first extension portion extends upward from the front panel of the basket to a first position higher than an end of the protruding portion in an inclined direction with respect to the front panel, the first extension portion being configured to support a rear surface of the protruding portion, wherein the second extension portion extends downward from a distal end of the first extension portion, wherein the knob further includes a third extension portion that extends downward from the second extension portion, and wherein the first extension portion is configured to elastically deform to move the distal end of the first extension portion to a second position lower than the end of the protruding portion based on the third extension portion being pulled forward.

16. The basket assembly according to claim 15, wherein the knob further includes:

a fourth extension portion that extends upward from the second extension portion to a third position higher than the end of the protruding portion, and a fastening groove defined between the second extension portion and the fourth extension portion and configured to receive the end of the protruding portion.

17. The basket assembly according to claim 15, wherein a length of the second extension portion is shorter than a length of the first extension portion.

18. The basket assembly according to claim 16, wherein the distal end of the first extension portion is located at a position higher than a distal end of the fourth extension portion.

19. The basket assembly according to claim 15, wherein the knob includes a first end and a second end opposite the first end that are spaced apart from the basket to form free ends.

20. The basket assembly according to claim 15, wherein the basket is rotatably or slidably provided at the basket assembly.

* * * * *